United States Patent [19]

Lauckhardt et al.

[11] Patent Number: 4,870,549

[45] Date of Patent: Sep. 26, 1989

[54] BUILT-IN CEILING LIGHT

[75] Inventors: Gerhard Lauckhardt, St. Georgen; Kurt Schmoll, Traunreut; Hadmar Kurzmann, Stein A.D. Traun, all of Fed. Rep. of Germany

[73] Assignee: Siemens Aktiengesellschaft, Munich, Fed. Rep. of Germany

[21] Appl. No.: 224,019

[22] Filed: Jul. 25, 1988

[30] Foreign Application Priority Data

Aug. 26, 1987 [DE] Fed. Rep. of Germany ..... 3728520

[51] Int. Cl.[4] ..... F21S 1/02

[52] U.S. Cl. ..... 362/147; 362/217; 362/260

[58] Field of Search ..... 362/147, 217, 260, 364

[56] References Cited

U.S. PATENT DOCUMENTS

| | | | |
|---|---|---|---|
| 2,925,490 | 2/1960 | Rosenfeld | 362/364 |
| 2,978,572 | 4/1961 | Bodiar | 362/364 X |
| 2,998,512 | 8/1961 | Duchene et al. | 362/364 |
| 3,057,993 | 10/1962 | Gellert | 362/364 |
| 3,883,732 | 5/1975 | Peterson et al. | 362/364 |
| 4,419,717 | 12/1983 | Price et al. | 362/364 X |

FOREIGN PATENT DOCUMENTS 1520786 3/1968 France .

OTHER PUBLICATIONS

"Bildschirmarbeitsplatz-Einbauleuchten Mit Bivergen-z-Spiegelraster", 1986.

*Primary Examiner*—Ira S. Lazarus
*Assistant Examiner*—Peggy Neils
*Attorney, Agent, or Firm*—Hill, Van Santen, Steadman & Simpson

[57] ABSTRACT

An improved built-in ceiling light. The dimensions of openings provided in false ceilings for the installation of built-in ceiling lights result in light housing dimensions which do not always provide the necessary storage space for the electrical components, in particular the ballast. It is known to obtain this necessary storage space by means of a projection from a side wall on the side of the housing base. However, this impedes the installation assembly. To avoid this difficulty the improved ceiling light has a projection which is a lid pivotally mounted to a housing base and to which the electrical components are attached. Then, during the insertion of the light housing, the lid, together with the electrical components, can be pivoted sufficiently far through a rectangular opening in a longitudinal side wall into the light housing.

10 Claims, 2 Drawing Sheets

BUILT-IN CEILING LIGHT

BACKGROUND OF THE INVENTION

The present invention relates to a built-in ceiling light for fluorescent strip lamps having a box-like light housing which contains lamp bases with sockets and other electrical components for holding a minimum of one fluorescent strip lamp. A reflector arrangement consisting of longitudinal side reflectors can be inserted into the housing, possibly in association with a reflector grid which closes off the light housing at the light outlet side opening. Along a longitudinal side wall on the side of a housing base the light housing is provided with a channeled projection which extends in a longitudinal direction. The electrical components for use with the minimum of one fluorescent strip lamp are accommodated in a storage space formed by the projection of the longitudinal side wall, the adjacent housing base and the longitudinal side reflector which is located on this side.

The openings provided in false ceilings of buildings for built-in lights of the type described above are generally standardized. The light housing of a built-in ceiling light which is to be inserted into such an opening must thus be adapted to the dimensions of the opening. In the case of a shallow installation height the reflector arrangement which is to be inserted into the housing for specific light transmitting properties may only permit the additional accommodation of electrical components, in particular the ballast, when additional storage space is provided in the form of a projection from a longitudinal side wall in the vicinity of the housing base of the light housing. Such a projection impedes the mounting of the built-in ceiling light in the false ceiling since the light can no longer be inserted into the opening in the false ceiling vertically from below. In order to insert the light housing into the opening of the false ceiling, the light housing must be tilted sideways in a longitudinal direction and its projection first inserted into the opening whereupon it is then completely inserted upwards into the ceiling through the opening.

SUMMARY OF THE INVENTION

An object of the present invention is to provide an improved built-in ceiling light of the type referred to in the introduction wherein the light housing is provided with a lateral projection for the electrical components, in particular the ballast, but wherein this projection is not an impediment to the ceiling mounting.

The projection of a longitudinal side wall of the light housing is a lid which is pivotally mounted to a housing base of the light housing and which fills an essentially rectangular opening in the longitudinal side wall. The lid has a U-shaped cross-section, open towards the light housing, for the accommodation of the other electrical components which are attached to the lid. The lid projects with a freely mobile U-flank through the opening in the longitudinal side wall into the light housing. For the perpendicular insertion of the light housing into an opening in a false ceiling the lid can be pivoted sufficiently far through the opening in the longitudinal side wall into the light housing.

The present invention is based on the fact that in modern built-in ceiling lights normally a light housing can be optionally provided with different reflector arrangements which, following the insertion of the light housing into the associated opening of a false ceiling, can be easily introduced from below into the light housing. Thus, when the light housing is inserted into an associated opening in a false ceiling, sufficient space is available within the light housing for the other electrical components apart from the lamp sockets, in particular the ballast, for such time as the reflector arrangement has not yet been introduced into the light housing. This fact is exploited by the present invention in an extremely advantageous fashion in that during the insertion of the light housing into the assigned opening of a false ceiling, the electrical components which are attached to a pivotable lid in an appropriate opening in a side wall can be pivoted through the opening in the longitudinal side wall into the light housing. As soon as the light housing is fixed in the false ceiling, the lid, with the other electrical components, can be moved laterally outwardly until it stops in a normal pivot position, and is locked therein. The reflector arrangement can then be easily and rapidly inserted into the housing from below through the light opening.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures of which like reference numerals identify like elements, and in which:

DESCRIPTION OF THE PREFERRED EMBODIMENTS

Figure 1:
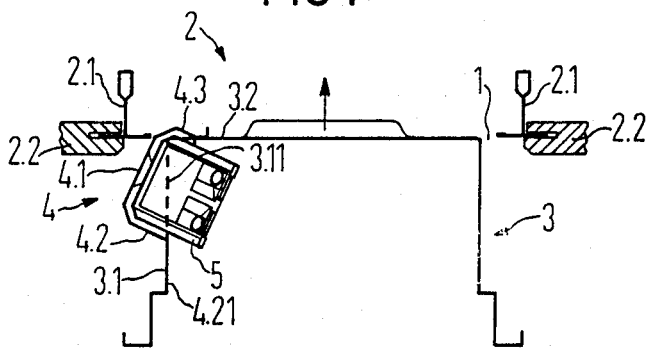
FIG. 1 is a cross-sectional schematic diagram of a light housing prior to installation into an assigned opening of a false ceiling.
Figure 2:
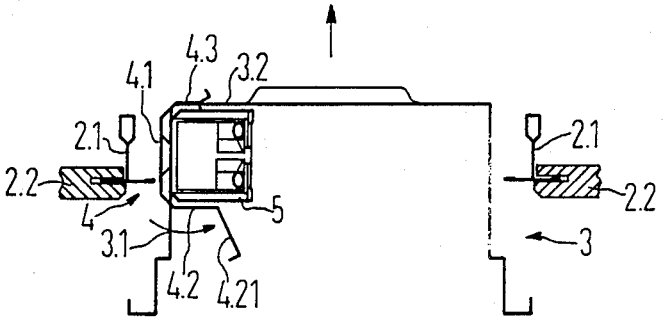
FIG. 2 is a cross-sectional diagram of the light housing corresponding to FIG. 1 during insertion into an assigned opening of a false ceiling.
Figure 3:
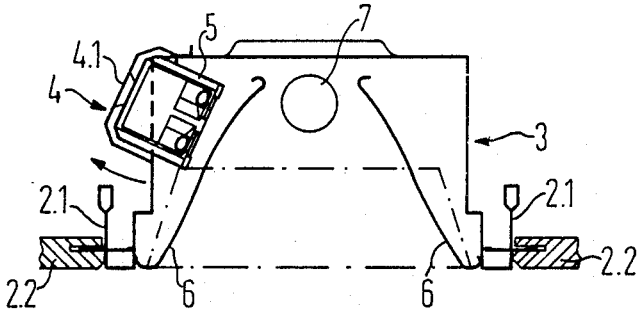
FIG. 3 is a cross-sectional diagram of the light housing corresponding to FIGS. 1 and 2 in the inserted state in an assigned opening of a false ceiling including the reflector arrangement and the fluorescent strip lamp.

As shown in FIGS. 1 through 5, a box-shaped light housing 3 which is to be inserted into an opening 1 in a false ceiling 2, shown here as supporting sections 2.1 and ceiling panels 2.2 arranged between the supporting sections 2.1, has a U-shaped projection 4. The U-shaped projection 4 is formed by a lid 4.1 which is pivotally mounted on a housing base 3.2 and which fills an essentially rectangular opening 3.11. This lid 4.1 has a U-shaped cross-section, open towards the light housing 3, for the accommodation of the electrical components 5 attached to the lid 4.1. The freely mobile U-flank 4.2 of the lid 4.1 projects through the opening 3.11 in the longitudinal side wall 3.1 and into the light housing 3 and has an angled section with a flank end 4.21 angled in relation to the light housing 3. The pivot mounting of the lid 4.1 and its U-flank 4.3, the length of which is shorter than the freely mobile U-flank 4.2, can be seen from the longitudinal side view of the light housing 3 in FIG. 5. The shortened U-flank 4.3 of the lid 4.1 continues, at one end, on both sides into a rotating arm 4.4 provided with a lug 4.41 aligned with the housing base 3.2, and by virtue of its lug 4.41 engages into a respective slot 3.21 in the housing base 3.2. These slots 3.21 determine the centers of rotation and bearing points for the lugs 4.41 in relation to the rotating arms 4.4.

The schematic diagram in FIG. 1 shows the light housing 3, with its projection 4, before insertion into the opening 1 of the false ceiling 2. The lid 4.1 with the ballast 5 is itself positioned in the normal pivot position in which the angled flank end 4.21 of the freely mobile U-flank 4.2 is in contact with longitudinal side wall 3.1. During the process of insertion of the light housing 3 into the opening 1 of the false ceiling 2, as can be seen from FIG. 2, the lid 4.1, together with the electrical components 5, can be pivoted inwardly into the light housing 3 in the direction of the arrow through the opening 3.11 in the longitudinal side wall 3.1 to such an extent that the light housing 3 can be effortlessly inserted through the opening 1 into the false ceiling 2. After the insertion of the light housing 3 into the false ceiling 2 in accordance with FIG. 3, the lid 4.1, with the ballast 5, is pivoted back into the normal pivot position in the direction of the arrow in FIG. 3, and is locked in this position. Then the fluorescent strip lamp 7 can be inserted into the base (not shown in detail), and the reflector arrangement, consisting of the side reflectors 6 and optionally of grid plates arranged at right angles to the side reflectors but only suggested in FIG. 3, can be inserted into the light housing 1.

Figure 4:
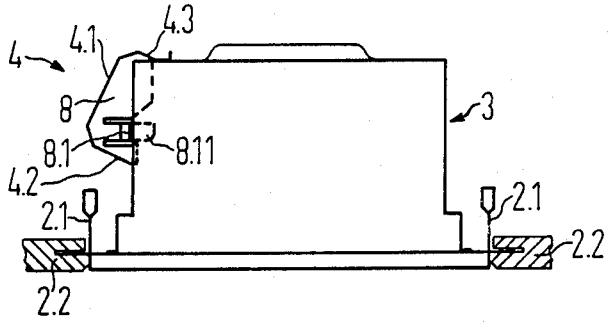
FIG. 4 is another cross-sectional view of a light housing corresponding to FIGS. 1 to 3 inserted into an assigned opening of a false ceiling.
Figure 5:
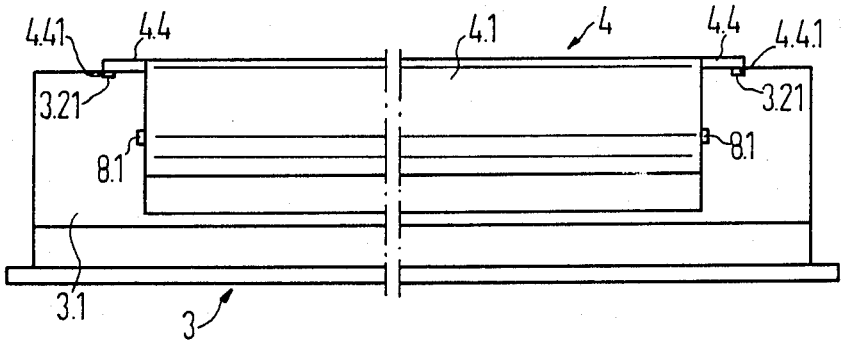
FIG. 5 is a view of the longitudinal side of the light housing corresponding to FIGS. 1 to 4 on the side of the projection which accommodates the ballast device.

The lid 4.1 is preferably provided at both ends with an end cover. A preferred embodiment is shown in FIG. 4. Here this cover 8 consists of attachable synthetic components adapted to the cross-sectional dimensions of the lid 4.1. These synthetic components are each provided with a spring lock 8.1 in the form of a resilient engaging lug which, in the normal pivot position of the lid 4.1, engages over the edge of the opening 3.11 in the longitudinal side wall 3.1 with its engaging lug. To permit an easy actuation of the spring lock 8.1 after the removal of the reflector arrangement from the light housing 3 in order to release the lock, the resilient engaging lugs are each provided with a projecting attachment 8.11.

In place of attachable synthetic components, the end covers 8 can also consist of components permanently connected to the lid 4.1, in particular sheet metal components which are provided with a spring lock, in a similar manner to the synthetic components. In place of the covers 8, which are each provided with a spring lock 8.1, the lid 4.1, together with the electrical components 5, can be supported in its normal pivot position, for example, by attaching the angled end 4.21 of the freely mobile U-flank 4.2 of the lid to the longitudinal side wall 3.1 by a screw.

The described built-in ceiling light can be used in various assemblies wherever the opening dimensions in the false ceilings for the installation of such lights necessitate special requirements for the accommodation of the ballast.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

We claim as our invention:

1. A built-in ceiling light for fluorescent strip lamps having a box-shaped light housing which contains a lamp base with sockets and other electrical components for at least one fluorescent strip lamp and into which can be inserted at last one reflector arrangement consisting of longitudinal side reflectors and a reflector grid which closes off the light housing on a side with a light outlet opening, the light housing being provided on a longitudinal side wall on the side of a housing base with a U-shaped projection which extends in a longitudinal direction, and the other electrical components for the fluorescent strip lamp being accommodated in a storage area formed by a projection of the longitudinal side wall the adjacent housing base and the longitudinal side reflector being located on this side, the projection of the longitudinal side wall comprising a lid which is pivotally mounted to the housing base and which fills an essentially rectangular opening in the longitudinal side wall, the lid having U-shaped cross-section, open towards the light housing, for the accommodation of the other electrical components which are attached to the lid, the lid projecting with a freely mobile U-flank through the opening in the longitudinal side wall into the light housing, and for the perpendicular insertion of the light housing into an opening in a false ceiling, the lid being pivoted sufficiently far through the opening in the longitudinal side wall into the light housing; the lid being provided at both ends with an end cover and the end covers being each provided with a spring lock for the releasable support of the lid in its normal pivot position, in which the angled flank end of the freely mobile U-flank of the lid contacts the longitudinal side wall of the light housing; the spring lock being a resilient engaging lug which, in the normal pivot position of the lid, engages over the edge of the opening in the longitudinal side wall.

2. The built-in ceiling light as drained in claim 1 wherein for its actuation the spring lock, which is formed by the resilient engaging lug, is provided with an attachment which extends beyond the engaging lug and projects into the light housing.

3. The built-in ceiling light as claimed in claim 1 wherein the lid is supported in its normal pivot position by the angled end of its freely mobile U-flank being detachable secured to the longitudinal side wall by means of a screw.

4. The built-in ceiling light as claimed in claim 1, wherein on the side of its pivot mounting on the housing base the U-shaped cross-section of the lid has a pivot U-flank, the length of which is shorter than the length of the freely mobile U-flank which projects into the opening in the longitudinal side wall, and wherein the freely mobile U-flank has an angled section with a flank and which is angled in relation to the light housing.

5. The built-in ceiling light as claimed in claim 1, wherein the end covers are sheet metal components, which are permanently attached to the lid.

6. The built-in ceiling light as claimed in claim 1, wherein the end covers are attachable synthetic components which are adapted to the cross-sectional dimensions of the lid.

7. A built-in ceiling light for fluorescent strip lamps having a box-shaped light housing which contains a lamp base with sockets and other electrical components for at least one fluorescent strip lamp and into which can be inserted at least on reflector arrangement consisting of longitudinal side reflectors, and a reflector grid which closes off the light housing on a side with a light outlet opening, the light housing being provided on a longitudinal side wall on the side of a housing base with a U-shaped projection which extends in a longitudinal direction, and the other electrical components for the fluorescent strip lamp being accommodated in a storage area formed by a projection of the longitudinal side wall, the adjacent housing base and the longitudinal side reflector being located on this side, the projection comprising:

a lid having a substantially U-shaped cross-section open towards the light housing and having a pivot U-flank and a freely mobile U-flank, the lid pivotably attached by its pivot U-flank to the housing base and substantially filling a substantially rectangular opening in the longitudinal side wall, the freely mobile U-flank projecting into the opening in the longitudinal side wall and having an angled section with a flank end which is angled in relation to the light housing, the pivot U-flank having a length which is shorter than the length of the freely mobile U-flank;

wherein the lid accommodates the other electrical components, and wherein for the perpendicular insertion of the light housing into an opening in a false ceiling, the lid can be pivoted sufficiently far through the opening in the longitudinal side wall into the light housing;

the lid being provided at both ends with an end cover;

the end covers being each provided with a spring lock for the releasable support of the lid in its normal pivot position, in which the angled flank end of the freely mobile U-flank of the lid contacts the longitudinal side wall of the light housing;

the spring lock being a resilient engaging lug which, in the normal pivot position of the lid, engages over the edge of the opening in the longitudinal side wall.

8. The built-in ceiling light as claimed in claim 7, wherein for its actuation the spring lock, which is formed by the resilient engaging lug, is provided with an attachment which extends beyond the engaging lug and projects into the light housing.

9. The built-in ceiling light as claimed in claim 7, wherein the end covers are sheet metal components, which are permanently attached to the lid.

10. The built-in ceiling light as claimed in claim 7, wherein the end covers are attachable synthetic components which are adapted to the cross-sectional dimensions of the lid.

* * * * *